United States Patent [19]

Kobayashi et al.

[11] Patent Number: 5,049,906

[45] Date of Patent: Sep. 17, 1991

[54] FIXING PROCESS CONTROLLER FOR ELECTROPHOTOGRAPHIC RECORDER

[75] Inventors: Shinya Kobayashi, Mito; Teruaki Mitsuya, Katsuta, both of Japan

[73] Assignees: Hitachi, Ltd.; Hitachi Koki Co., Ltd., both of Tokyo, Japan

[21] Appl. No.: 325,368

[22] Filed: Mar. 20, 1989

[30] Foreign Application Priority Data

Mar. 22, 1988 [JP] Japan ..... 63-65637

[51] Int. Cl.[5] ..... G03G 15/20

[52] U.S. Cl. ..... 346/160.1; 346/157; 355/208; 355/285

[58] Field of Search ..... 355/206, 208, 285, 289, 355/290, 311, 282; 219/216; 432/60; 346/157, 160.1

[56] References Cited

U.S. PATENT DOCUMENTS

| | | | |
|---|---|---|---|
| 4,355,881 | 10/1982 | Tarumi et al. | 355/282 |
| 4,549,803 | 10/1985 | Ohno et al. . | |
| 4,566,778 | 1/1986 | Sasaki . | |

FOREIGN PATENT DOCUMENTS

| | | | |
|---|---|---|---|
| 3314153 | 10/1983 | Fed. Rep. of Germany . | |
| 56-164374 | 12/1981 | Japan . | |
| 57-108876 | 7/1982 | Japan . | |
| 60-191278 | 9/1985 | Japan | 355/282 |
| 61-20970 | 1/1986 | Japan . | |
| 61-126585 | 6/1986 | Japan | 355/285 |
| 61-285460 | 12/1986 | Japan | 355/290 |
| 62-47669 | 3/1987 | Japan | 355/282 |

*Primary Examiner*—Joan H. Pendegrass

*Attorney, Agent, or Firm*—Antonelli, Terry, Stout & Kraus

[57] ABSTRACT

A fixing process controller of an electrophotographic recorder controls a fixing unit which fixes an unfixed toner image on a recording medium by passing the medium between two fixing rollers. The controller comprises means for detecting the thickness of unfixed toner layers on the recording medium; means for determining the ability of the fixing rollers suitable for fixing toner with a toner thickness detected by the thickness detection means; and control means which controls the operation of the fixing rollers to have the exertion of the ability determined by the ability determination means.

10 Claims, 5 Drawing Sheets

FIXING PROCESS CONTROLLER FOR ELECTROPHOTOGRAPHIC RECORDER

BACKGROUND OF THE INVENTION

This invention relates to a controller of a fixing unit of an electrophotographic color recorder, and particularly to a fixing process controller for an electrophotographic recorder suitable for fixing thick layers of a toner image.

The electrophotographic process involves charging, light exposure, development, image transfer and fixing. In color recording, toner images of colors are transferred to a sheet of paper, and thereafter, the toner is fixed. In portions of a picture, where many colors are used, the toner layers have an increased thickness, which necessitates fixing control. Among the conventional techniques, one disclosed in Japanese Laid-Open Patent Application No. 61-20970 (1986) enters information as to whether the recording picture is in a single color or multiple colors on the basis of an operator's judgement. Another technique disclosed in Japanese Laid-Open Patent Application 57-108876 measures the toner thickness in terms of toner consumption in the developer.

In color recording, the toner thickness extends as much as 3–4 times that of single-color recording, and the thickness of the toner layers must be taken into consideration for the fixing process. Faulty fixing results not only in the exfoliaton of toner, but also the degradation of color development due to insufficient fusion of lower toner layers, in color recording. Conversely, an excessive fixing process causes waste of power and premature breakdown of the fixing apparatus, and also offset and crease of paper in the case of heat fixing. On this account, it is difficult for the method of simple selection as described in the above-mentioned patent publication No. 61-20970 and the method described in the above-mentioned patent publication No. 57-108876 to have precise control over the toner thickness.

SUMMARY OF THE INVENTION

An object of this invention is to provide a fixing process controller for an electrophotographic recorder operative to fix toner in response to a varying toner thickness in color recording.

The above objective is achieved through the evaluation of the toner thickness from the image signal supplied from an external signal source using a toner thickness calculation means built in the recorder, and exerting a proper fixing force based on the evaluation.

In color recording, there is a virtual correlation between the concentration and toner thickness on the image, and therefore the thickness of toner layers can be inferred from the image signal. The image signal is supplied in terms of each pixel and toner of each color, and accordingly through the calculation of the toner thickness from image information, it becomes possible to detect the toner thickness in each portion of an image and to have fixing control which matches the detection result, and an efficient fixing process is made possible.

DESCRIPTION OF THE PREFERRED EMBODIMENTS

Embodiments of this invention will be described in detail in the following.

Figure 4:
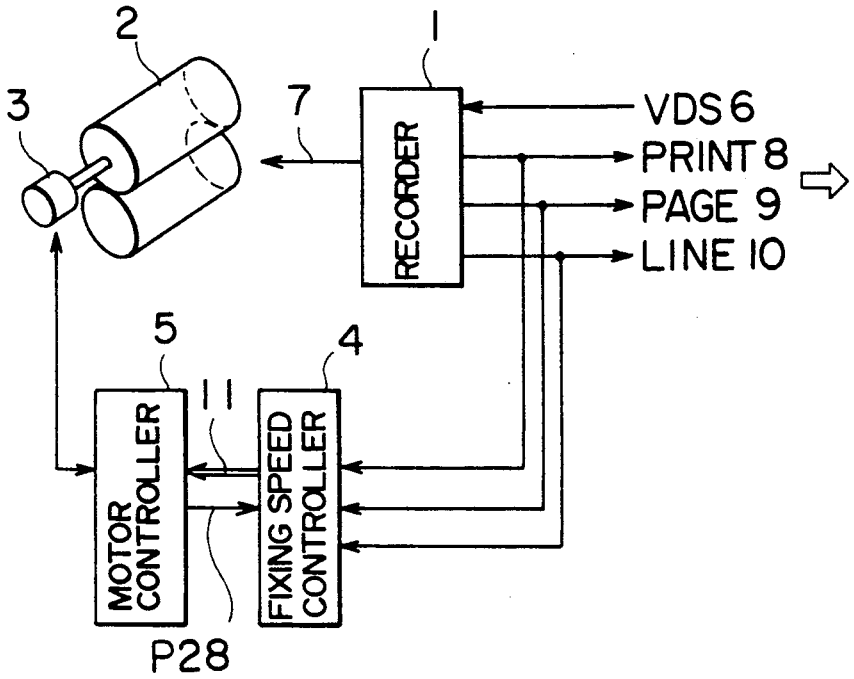
FIG. 4 is a block diagram showing the arrangement of the electrophotographic recorder which uses the inventive fixing controller.

FIG. 4 is a block diagram showing, as an example, the arrangement of a recorder which uses the inventive controller. The recorder is an image recorder which receives an image signal (VDS) 6 from a host system. A known electrophotographic recorder 1, which is separate from a fixing unit, transfers a toner image 7 derived from the image signal 6 onto a sheet of paper, and moves the paper to a fixing unit 2.

Figure 5:
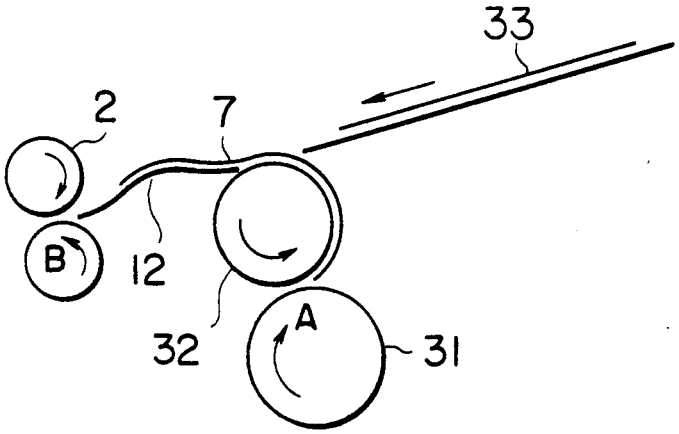
FIG. 5 is a block diagram showing the structure in the periphery of the fixing unit of the inventive fixing controller.

FIG. 5 shows the structure of recorder including the fixing unit 2. The recorder of this embodiment is a full-color recorder in which toner of multiple colors is transferred to a sheet of paper 33 on a transfer drum 32, one color in each revolution, and finally are the toner is fixed at one time. In operation, the paper 33 is wound on the transfer drum 32 and held by a detent of the drum at the commencement of recording. Toner images 7 formed on a photosensitive drum 31 are transferred to the paper, one color in each revolution, at the transfer point A. After the last transfer operation, the paper is removed from the drum 32 and moved along the paper guide 12 to the fixing unit 2. The guide 12 is designed to have such a length that when the leading edge of the paper has reached the fixing point B, the trailing edge of the paper passes the transfer point A. The detent of the drum 32 holds the paper at least until the leading edge of the paper reaches the fixing point B. The paper feed speed in the fixing unit 2 is generally slower than that on the drum 32, and the paper 7 may be slack on the guide 12. To cope with the matter, the guide 12 is curved as shown in the figure, allowing the paper to swell out. This structure allows the paper feed speed in the fixing unit 2, i.e., the fixing speed, to be varied arbitrarily within the range below the paper feed speed on the drum 32.

Figure 6:
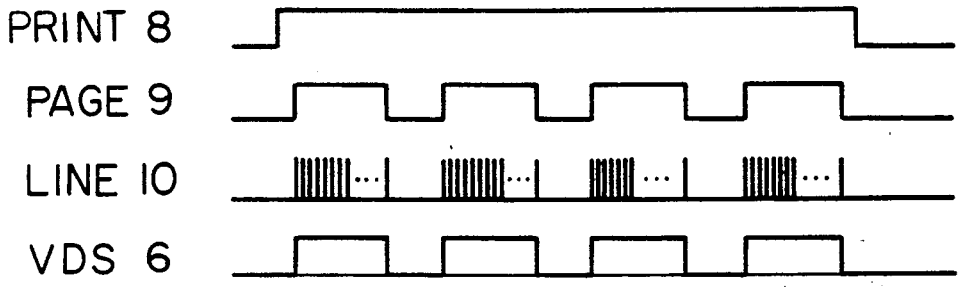
FIG. 6 is a timing chart showing the signals from a host system.

Returning to FIG. 4, a fixing speed controller 4 according to this invention will be explained. Generally, the recorder 1 transmits, to a host system (not shown) which is the source of a recording image, a recording signal (PRINT) 8 indicating that recording is in progress, a plate signal (PAGE) 9 indicating that recording in a specific color is in progress, and a synchronizing signal (LINE) 10 for each line. FIG. 6 shows in a timing chart these signals in the case of transferring four colors of yellow Y, magenta M, cyan C, and black Bk in this order. The controller 4 receives these signals and produces a fixing speed signal 11 for a motor controller 5.

Figure 1:
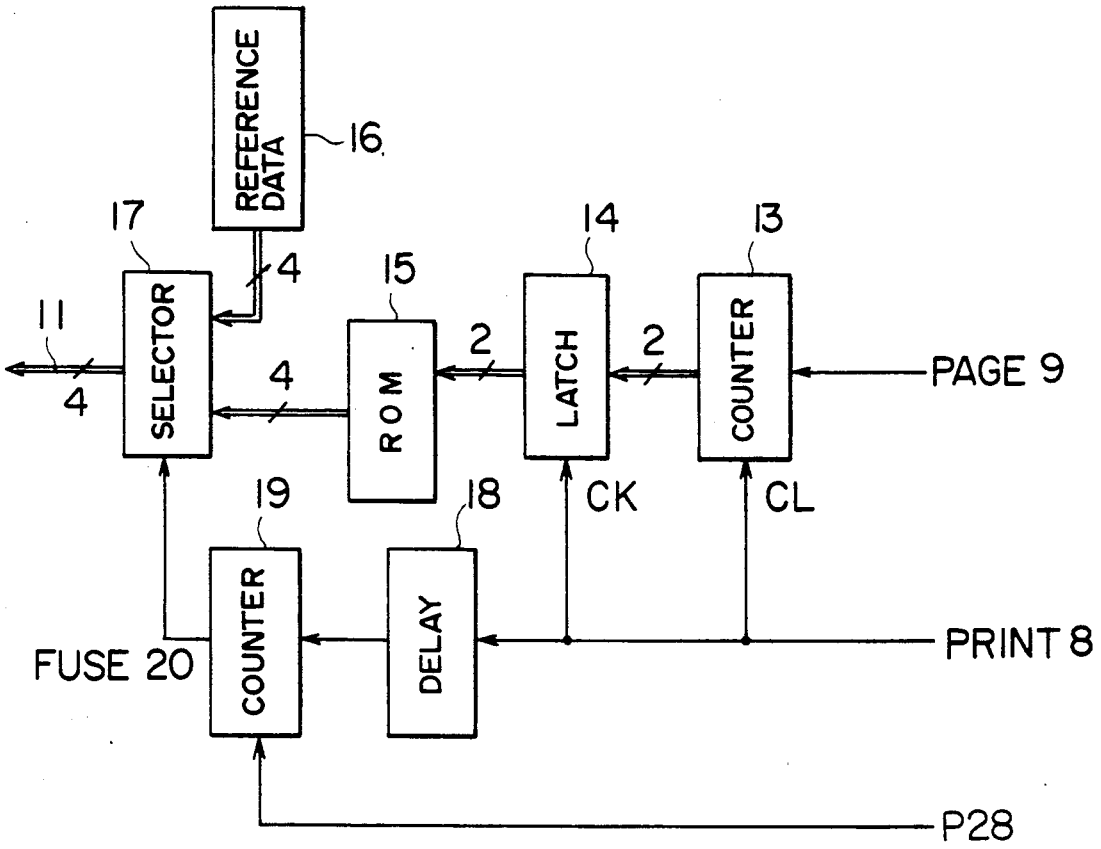
FIG. 1 is a block diagram showing a first embodiment of the inventive controller.

FIG. 1 shows an embodiment of the controller 4. When the recording signal 8 has turned to "high", a counter 13 which has been in a cleared state of "0" counts the number of plate signal 9. On completion of recording, when the recording signal 8 goes "low", the contents of the counter 13 is held by a latch 14. The latched number indicates the number of transfer operations, which ranges from one (single-color transfer) to four (4-color transfer with Y, M, C and Bk). Accordingly, the counter 13 can be a 2-bit binary counter.

A ROM 15 stores the circumferential speeds of the fixing roll in correspondence to the number of transfer colors as an address, as listed in Table 1. The circumferential speeds preset in the ROM 15 are based on a prior experiment. The values of Table 1 are formatted in binary, i.e., 4-bit data (not shown) in this embodiment.

TABLE 1

| Number of transfer colors | Fixing roll circumferential speeds (m/s) |
|---|---|
| 1 | $7.5 \times 10^{4}r$ |
| 2 | $4.7 \times 10^{4}r$ |
| 3 | $3.8 \times 10^{4}r$ |
| 4 | $3.2 \times 10^{4}r$ |

The recording signal 8 is delayed by a delay circuit 18 until the leading edge of the paper comes to the position of the fixing roll 2, and it enables the counter 19. The counter 19 counts pulses 28 of an encoder 3. The counter 19 has a preset value of paper size in terms of encoder pulses, and it provides a selector 17 with a signal (FUSE) 20 indicating that fixing is in progress after the leading edge of the paper has entered the fixing unit until the trailing edge of the paper comes out of the fixing unit. The selector 17 normally provides reference data 16 for the reference speed (the highest speed $7.5 \times 10^{4}r$ m/s out of four in this embodiment), or it provides speed data retrieved from the ROM 15 during the fixing process with the fixing signal 20 being enabled.

Referring back to FIG. 4, a motor controller 5 bases its operation on the 4-bit speed information from the controller 4 to control the rotation of a motor 3 so that the fixing roll circumferential speed is as shown in Table 1. Since the accuracy of speed required is not so high, a conventional PLL-based DC servo system may be used, for example. The encoder pulses 28 mentioned previously are sent to the controller 4.

According to this embodiment, the fixing process is carried out at an optimal fixing roll speed determined by a prior experiment for each case from single-color to four-color recording. Consequently, the toner fixing property is enhanced in every case, the color development of low toner layers is improved by color intermixing, and a high quality color image can be reproduced.

The 1-drum multiple transfer system has a total transfer time which increases in proportion to the number of colors transferred. Table 2 shows the transfer time and the fixing time based on the roll speeds of Table 1 for each number of transfer colors demonstrated by this embodiment. The fixing time is shorter than the transfer time in any case. This embodiment is designed to use the time period in which the fixing unit is idling conventionally, and therefore the recording speed does not fall in the case of continuous recording.

TABLE 2

| Number of transfer colors | Transfer time (sec) | Fixing time (sec) for A4-size paper |
|---|---|---|
| 1 | 5 | 4.0 |
| 2 | 10 | 6.4 |
| 3 | 15 | 7.9 |
| 4 | 20 | 12.7 |

Figure 2:
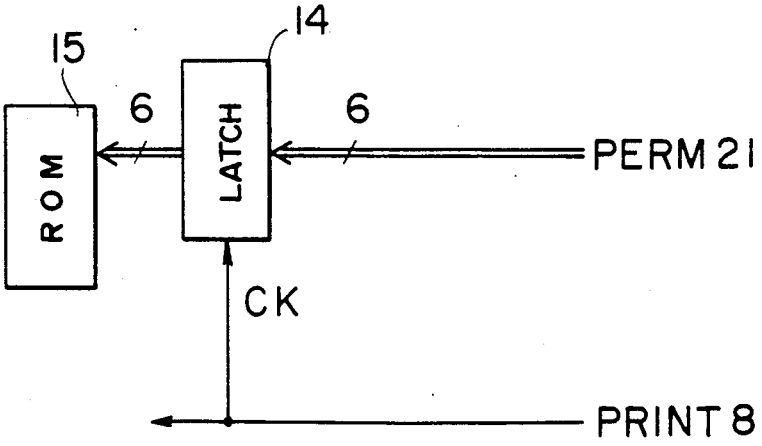
FIG. 2 is a block diagram showing a second embodiment of the inventive controller.

FIG. 2 shows the second embodiment of the controller 4, in which the thickness of the unfixed toner image 7 on the paper 33 is detected on the basis of the kinds of toner which are transferred to the paper 33 and the order in which they are transferred on the basis a transfer permutation signal (PERM) 21 which is entered to the latch 14 of FIG. 1 in place of the count value of plate signal 9. In the full-color recorder, the number of colors transferred and the order of transfer, among toners of yellow Y, magenta M, cyan C and black Bk, can be changed arbitrarily, thus causing the thickness of the resulting toner layer to vary. The number of permutations is 64 as calculated by qpn+qpo+qpp+qpq, and the transfer permutations signal 21 can be formed in six bits. The signal 21 is supplied together with the image signal 6 from the host system. The ROM 15 receives the transfer permutation signal 21 held in the latch 14 and provides the fixing speed optimal to each order (not displayed).

This embodiment allows the setting of the fixing speed separately for each of Y, M, C and Bk even in the case of 1-color transfer. For 2-color recording, the difference in color development depending on the transfer order can be taken into consideration, and the fixing process can take place always at the optimal fixing speed.

Figure 3:
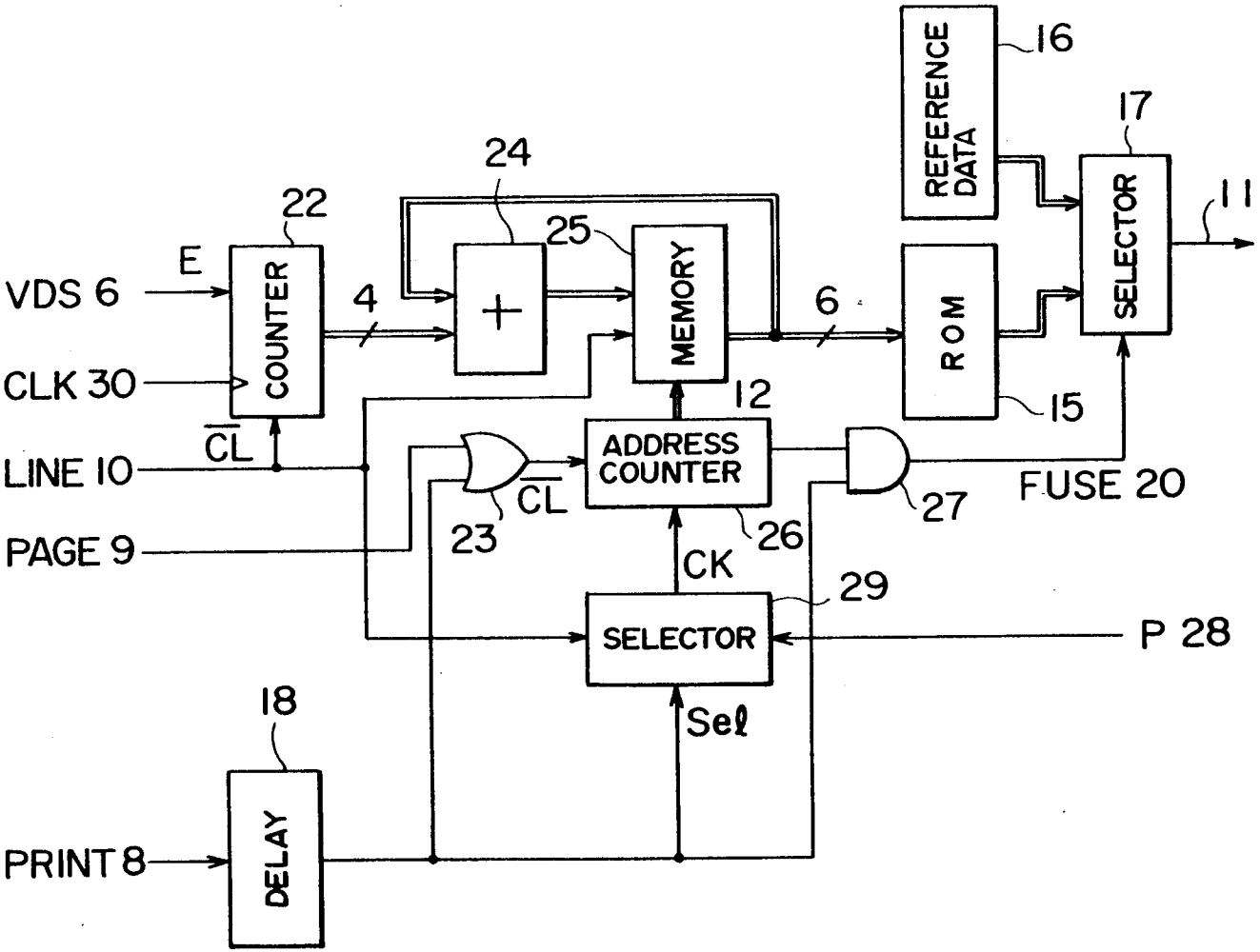
FIG. 3 is a block diagram showing a third embodiment of the inventive controller.

FIG. 3 shows the third embodiment of the controller 4, in which portions identical to those of FIG. 1 are referred to by the common numbers and explanation thereof will be omitted. The controller has counters 22 and 26 and memory 25 cleared to zero initially. When recording begins, the plate signal 9 goes "high" and the counter 26 starts counting a synchronizing signal 10 as selected by a selector 29, and the counter 26 counts the number of lines. The number of lines is usually around 4000, and the counter 26 is a 12-bit binary counter in this embodiment. The output of the counter 26 is used to address a memory 25. At the commencement of recording of each line, when the synchronizing signal 10 goes "high", the counter 22 starts counting a "high" image signal 6 in synchronism with the dot-wise sync signal (CLK) 30. Accordingly, in recording a color dot or a white dot in response to a "high" or "low" image signal 6, respectively, the output of the counter 22 when the sync signal 10 goes "low" represents the total number of color dots on one line. The number of dots on one line is usually around 4000, and therefore the counter 22 is a 12-bit binary counter in this embodiment. The counter 22 has only high-order 4-bit output, thereby simplifying the following circuit, in this embodiment.

With the sync signal 10 going "low", the contents of the memory 25 are added to the output of the counter 22 by an adder 24, and the result is stored back in the memory 25. The counter 22 has a 4-bit output for dealing with 4-color transfer at maximum, and the memory 25 has six bits for each line. A page of A4-size paper has about 4000 lines, and the memory 25 is provided with a 24K bits capacity.

When the sync signal 10 goes "high" again, the counter 26 increments and the access to the memory 25 is shifted to the next line. In this way, recording for one color is completed, the total number of color dots on each line is stored in the memory 25, and the plate signal 9 goes "low". At the commencement of recording for the next color, when the plate signal 9 goes "high", the same operational sequence is repeated. In this case, however, the memory 25 is not cleared, but it sums the number of dots of the next color. After the transfer process has completed and the paper is transported to the fixing unit, the recording signal 8 delayed by the delay circuit 18 goes "high" to operate the counter 26 through an OR gate 23. At this time, the counter 26 counts pulses 28 as selected by the selector 29. The counter 26 has a presetting of paper size, as mentioned previously, and it brings the fixing signal 20 to "high" when the paper is passing through the fixing unit and to "low" when the paper has been delivered. Since the fixing signal 20 is gated by the delayed recording signal 8 using an AND gate 27, it is active only during the fixing process. By being addressed by the counter 26, the memory 25 provides the total number of color dots on one line for the ROM 15. The ROM 15, in turn, is addressed by this information to read out the fixing roll speed to the selector 17. The ROM 15 having a 6-bit input can provide 64 kinds of circumferential speed information determined by a prior experiment. The table of ROM contents is similar to Table 1 (the contents are increased from 4 to 64). The selector 17 selects for its output 11 the output of ROM 15 when the fixing signal 20 is "high", or the reference data 16 when it is "low".

According to this embodiment, the fixing roll speed can be made optimal for each line during the fixing process of one page. For example, when a sheet of paper has its former half left white and its latter half printed completely, the former section is fixed fast and the latter section is fixed slowly thereby to accomplish the optimal fixing for both sections, and the total fixing time is also reduced.

Next, examples of application of the foregoing embodiment will be described.

Figure 7:
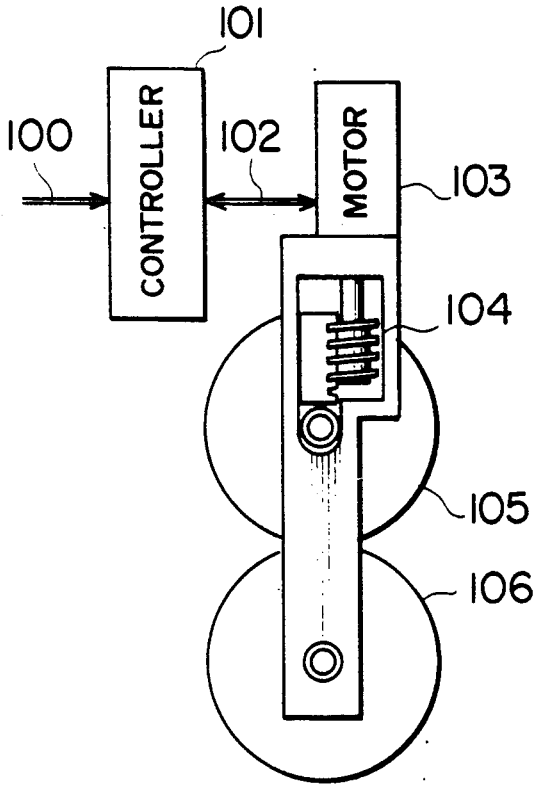
FIG. 7 is a diagram showing a pressure fixing unit that is a conventional fixing controller.

The first example is the application to a pressure fixing unit. FIG. 7 shows a known pressure fixing unit, which has two pressure rollers 105 and 106. One roller 105 is pressed to the other roller 106 by means of a servo motor 103 and screw 104. A potentiometer is attached to the motor 103, and it indicates the rotational angular displacement to a controller 101 (equivalent to the controller 5 in FIG. 4). The controller 101 compares the displacement with the pressure input 100 and varies the angular displacement of the motor 103 in proportion to their difference, thereby controlling the pushing pressure between the rollers 105 and 106.

In this pressure fixing unit, the reference data 16 in FIGS. 1 and 3 which is selected when paper is absent in the fixing unit is the pushing pressure between the rollers in the non-fixing mode, and it is normally set to zero thereby to relieve the mechanical stress. Data resident in the ROM 15 and selected during the fixing process is a set of optimal roller pressures determined in advance based on experiment for numbers of transfer colors and numbers of color black dots on a line on the paper. The selected output 11 in FIGS. 1 and 3 becomes the pressure input 100 to the pressure fixing unit in FIG. 7.

This embodiment avoids the exertion of unnecessary fixing pressure, which results in the enhancement in the fixing property and color development, and is also advantageous from the viewpoint of paper protection and structural strength.

Figure 8:
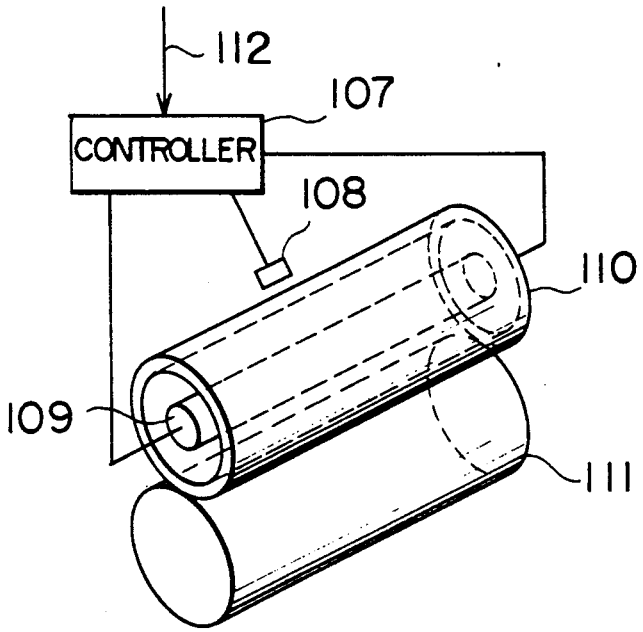
FIG. 8 is a diagram showing a heat fixing unit that is a conventional fixing controller.

The second example is the application to a heat fixing unit. Shown in FIG. 8 is a known thermal fixing unit, which has two heat rollers 110 and 111, with one roller 110 incorporating a heater 109 such as a xenon lamp. The roller 110 is provided with a surface temperature sensor 108 such as a thermistor on its surface, so that the roller surface temperature is controlled by a controller 107. The controller 107 compares the temperature input 112 with the input from the sensor 108 and regulates the heat output of the heater 109 in proportion to their difference.

In this heat fixing unit, the reference data 16 in FIGS. 1 and 3 which is selected when paper is absent in the fixing unit is the roller surface temperature in non-fixing mode, and it is usually set to the temperature required for fixing a white paper or lower thereby to save the power consumption. Data resident in the ROM 15 selected during the fixing process is a set of optimal roller surface temperatures determined by a prior experiment for numbers of transfer colors and numbers of color black dots on a line on the paper. The selected output 11 in FIGS. 1 and 3 becomes the input 112 to the thermal fixing unit in FIG. 8. In case there is a significant time lag for the surface temperature to follow the setting of the heat output of the heater 109, the address counter 26 in FIG. 3 is advanced in proportion to the time lag so that the memory 25 in FIG. 3 is read out earlier.

This embodiment avoids the generation of unnecessary fixing heat, and is effective in paper protection, heat offset prevention and power saving, as well as the enhancement of fixing property and color development.

According to this invention, the multiple-transfer color electrophotographic printer has the circumferential speed, pressure, or temperature of the fixing roller made variable based on such information as the toner thickness of each color, fixing property and the order of toner layers, whereby such problems as offset due to too much fusion, degraded resolution, bubble generation, exfoliation due to faulty fixing, and incomplete color development of lower toner layers can be prevented, and the optimal fixing condition effectively reproduces a high quality color image.

What is claimed is:

1. A fixing process controller for controlling a fixing unit of an electrographic printer which records a toner image on a recording medium on the basis of digital pixel data output from a computer, said fixing unit fixing an unfixed toner image on said recording medium by passing said recording medium between two fixing rollers, said controller comprising:

means for detecting a thickness of said unfixed toner image on said recording medium on the basis of said digital pixel data;

means for determining an operating parameter of said fixing rollers suitable for fixing toner having said thickness detected by said toner thickness detecting means; and control means for controlling said fixing rollers to operate with said operating parameter determined by said determining means.

2. A fixing process controller according to claim 1, wherein said toner thickness detecting means also detects said toner thickness on the basis of a number of times toner is transferred to said recording medium to form said unfixed toner image.

3. A fixing process controller according to claim 1, further comprising a transportation system for transporting said recording medium having said unfixed toner image thereon to said fixing rollers, wherein said transportation system comprises a curved guide for guiding said recording medium having said unfixed toner image thereon.

4. A fixing process controller for an electrophotographic recorder according to claim 1, wherein said determining means comprises:

means for detecting a fixing operation and a non-fixing operation of said fixing rollers; and means for outputting an operating parameter of said fixing rollers suitable for fixing toner having said thickness detected by said thickness detecting means in response to detection of said fixing operation, and for outputting a predetermined operation parameter of said fixing rollers in response to detection of said non-fixing operation.

5. A fixing process controller for an electrophotographic recorder according to claim 1, wherein said operating parameter is a speed of said fixing rollers.

6. A fixing process controller for an electrophotographic recorder according to claim 1, wherein said operating parameter is a pressure applied by said fixing rollers.

7. A fixing process controller for an electrophotographic recorder according to claim 1, wherein said operating parameter is a temperature of said fixing rollers.

8. A fixing process controller according to claim 1, wherein said electrophotographic printer is a multiple-transfer color electrophotographic recorder.

9. A fixing process controller for an electrophotographic recorder for controlling a fixing unit which fixes an unfixed toner image on a recording medium by passing said recording medium between two fixing rollers, said controller comprising:

mans for detecting a thickness of said unfixed toner image on said recording medium;

means for determining an operating parameter of said fixing rollers suitable for fixing toner having said thickness detected by said toner thickness detecting means; and control means for controlling said fixing rollers to operate with said operating parameter determined by said determining means;

wherein said toner thickness detecting means detects said toner thickness on the basis of kinds of toner which are transferred to said recording medium to form said unfixed toner image and an order in which said kinds of toner are transferred to said recording medium.

10. A fixing process controller for an electrophotographic recorder for controlling a fixing unit which fixes an unfixed toner image on a recording medium by passing said recording medium between two fixing rollers, said controller comprising:

means for detecting a thickness of said unfixed toner image on said recording medium;

means for determining an operating parameter of said fixing rollers suitable for fixing toner having said thickness detected by said toner thickness detecting means; and control means for controlling said fixing rollers to operate with said operating parameter determined by said determining means;

wherein said unfixed toner image comprises a plurality of lines of color dots and non-color dots;

wherein said toner thickness detecting means detects the thickness of each line of said unfixed toner image by counting said color dots or said non-color dots in each line of said unfixed toner image; and wherein said determining means determines said operating parameter of said fixing rollers for each line of said unfixed toner image.

* * * * *